US007640872B2

(12) United States Patent
Martin et al.

(10) Patent No.: US 7,640,872 B2
(45) Date of Patent: Jan. 5, 2010

(54) PROCESS FOR INFLUENCING THE PROPERTIES OF COMBUSTION RESIDUE

(75) Inventors: Johannes Martin, München (DE); Oliver Gohlke, München (DE)

(73) Assignee: Martin GmbH für Umwelt- und Energietechnik, München (DE)

( * ) Notice: Subject to any disclaimer, the term of this patent is extended or adjusted under 35 U.S.C. 154(b) by 226 days.

(21) Appl. No.: 11/250,537

(22) Filed: Oct. 14, 2005

(65) Prior Publication Data

US 2006/0081161 A1 Apr. 20, 2006

(30) Foreign Application Priority Data

Oct. 14, 2004 (DE) ..... 10 2004 050 098

(51) Int. Cl.
*F23B 7/00* (2006.01)

(52) U.S. Cl. ..... 110/342; 110/165 R; 110/346

(58) Field of Classification Search ..... 110/342, 110/165 R, 266, 165 A, 246, 185, 186, 346
See application file for complete search history.

(56) References Cited

U.S. PATENT DOCUMENTS 2,844,112 A * 7/1958 Muller ..... 431/3
4,572,085 A * 2/1986 Hepworth ..... 110/345
4,831,943 A 5/1989 Aune
5,241,916 A * 9/1993 Martin ..... 110/348
5,259,863 A 11/1993 Schneider et al.
5,606,924 A * 3/1997 Martin et al. ..... 110/341
5,662,049 A 9/1997 Shimizu et al.
5,685,244 A 11/1997 Goldfarb et al.
6,145,453 A 11/2000 Martin et al.
6,415,453 B1 * 7/2002 Anderson et al. ..... 2/458

(Continued)

FOREIGN PATENT DOCUMENTS

CA 2108677 8/1993

(Continued)

OTHER PUBLICATIONS

Japanese Office Action for corresponding Japanese Application No. 2005-299004 issued on Feb. 20, 2008.

(Continued)

*Primary Examiner*—Kenneth B Rinehart
(74) *Attorney, Agent, or Firm*—Cohen Pontani Lieberman & Pavane LLP

(57) ABSTRACT

Combustion residue can be partially melted and/or sintered in the combustion bed of a grate furnace system. By returning the unmelted and/or unsintered combustion residue, completely sintered inert granulates are obtained. To control the melting and/or sintering processes, at least one of the following process steps is implemented: the residues are returned only as long as, and only in such an amount that the changes thus caused in the essential combustion parameters remain within previously defined tolerance limits; the combustion conditions of the combustion process are changed in such a way as to counteract the changes in the combustion parameters produced by the return; the material composition of the combustion residue is changed by the return of selected fractions of the combustion residue so that the melting and/or sintering process of the combustion residue is influenced; and the material composition of the combustion residue is changed by the addition of additives is that the melting and/or sintering process of the combustion residue is influenced.

16 Claims, 2 Drawing Sheets

U.S. PATENT DOCUMENTS

| | | | |
|---|---|---|---|
| 6,647,902 | B1 | 11/2003 | Martin et al. |
| 6,662,735 | B2 | 12/2003 | Tischer et al. |
| 6,796,251 | B2 | 9/2004 | Martin et al. |
| 6,986,312 | B2 | 1/2006 | Martin et al. |
| 2003/0183138 | A1 | 10/2003 | Martin et al. |

FOREIGN PATENT DOCUMENTS

| | | | |
|---|---|---|---|
| CA | 2121295 | | 8/2000 |
| DE | 43 12 820 | C2 | 10/1994 |
| DE | 198 20 038 | A1 | 11/1999 |
| DE | 198 56 417 | A1 | 6/2000 |
| DE | 199 19 222 | C1 | 1/2001 |
| DE | 695 19 400 | T2 | 5/2001 |
| DE | 102 13 788 | | 10/2003 |
| EP | 0 581 918 | B1 | 2/1994 |
| EP | 0 862 019 | | 9/1998 |
| EP | 0 952 391 | A2 | 10/1999 |
| EP | 1 046 861 | B1 | 10/2000 |
| EP | 1 197 706 | A2 | 4/2002 |
| EP | 1 260 599 | A2 | 11/2002 |
| EP | 0 862 019 | B1 | 1/2003 |
| EP | 1 348 907 | A1 | 10/2003 |
| EP | 1 359 374 | A1 | 11/2003 |
| EP | 1 013 991 | B1 | 5/2004 |
| JP | 2003-287217 | | 10/2003 |
| WO | WO 01/61246 | A1 | 8/2001 |

OTHER PUBLICATIONS

German Office Action for corresponding German Application No. 10 2004 050 098.3-23 dated Sep. 20, 2005.

* cited by examiner

PROCESS FOR INFLUENCING THE PROPERTIES OF COMBUSTION RESIDUE

BACKGROUND OF THE INVENTION

1. Field of the Invention

The invention relates to a process for influencing the properties of combustion residue from a combustion plant, especially a waste incinerator, in which the fuel is burned on a furnace grate and the unmelted and/or unsintered combustion residue which accumulates is returned to the combustion process. Most of the combustion residue originates from the ash content of the fuel and is obtained in the form of grate ash—frequently referred to as slag—in the deslagger. The residues can also include fly ash from the boiler or from the off-gas filtration unit. Grate ash can also contain metal, glass, and ceramic components.

2. Description of the Related Art

A process of this type is known from German Patent No. 102 13 788. In this process, combustion is regulated in such a way that a portion of the combustion residue melts and/or sinters in the combustion bed of the main combustion zone, whereas the unmelted and/or unsintered combustion residues are separated at the end of the combustion operation and returned to the combustion process.

It is also known from European Patent No. 0 862 019 that flue dust can be metered into the high-temperature zone of the combustion furnace, where the temperature is above the melting or sintering temperature of the flue dust. The fly ash, i.e., flue dust, of specific combustion conditions which promote the formation of toxic organic pollutants such as PCDD/PCDF and/or precursor compounds such the precursors of PCDD and PCDF.

These processes take no account of the fact that the return of the combustion residue can have a significant effect on the combustion process. Of particular importance in this regard are the percentage of combustion residue in the fuel mixture and the change in the material composition of the combustion residue.

The return of combustion residue leads, for example, to an increase in the proportion of combustion residue in the fuel mixture and thus to a decrease in the temperature of the combustion bed. Because of the lower combustion bed temperature, the proportion of unmelted and/or unsintered components in the combustion residue increases even more. When these amounts are returned again in turn without regulation in accordance with German Patent No. 102 13 788, for example, the temperature of the combustion bed will continue to drop, which will be disadvantageous.

The material composition of the combustion residue, furthermore, can also change as a result of its return. Unmelted and/or unsintered combustion residue in the form of fine slag fractions have, for example, higher calcium oxide contents and lower iron oxide contents than the average composition of the combustion residue. This means that the average lime content of the combustion residue can increase over time as a result of the return of fine slag fractions as done in accordance with German Patent No. 102 13 788.

The melting and/or sintering process is determined by the material composition of the fuel and of the returned combustion residue, this composition being in turn the crucial factor which determines the melting temperature and the reactivity during sintering reactions, and by the combustion conditions, which are the deciding factor with respect to the combustion bed temperature and other essential combustion parameters. The amount of fuel mixture supplied; the point of introduction; the stoking by the grate; and the quantities of air, oxygen, and recycled off-gas and their temperatures determine the combustion conditions.

In the following, a distinction is made between "combustion conditions" and "combustion parameters." Thus the combustion conditions are the settings which one is able to make or to influence directly by means of control devices. These include, for example, the quantity of fuel mixture supplied (fuel mixture=fuel+returned combustion residue), the point of introduction, and the rate and temperatures at which air, oxygen, and returned off-gas are supplied.

The combustion parameters are defined as the variables which cannot be set directly by means of control devices but rather which are the result of the combustion conditions. These include, for example, the temperature of the combustion bed, the temperature of the combustion chamber, the amount of steam produced, and the $O_2$ content in the off-gas. The composition of the fuel (calorific value, water content, ash content) is also considered a combustion parameter, because it cannot be directly influenced or controlled in the case of waste materials.

SUMMARY OF THE INVENTION

An object of the invention is to provide a process by means of which it can be guaranteed that essentially all of the solid combustion residue in the combustion bed is sintered and/or melted.

The object is accomplished by a process of the invention, in which the melting and/or sintering processes in the combustion bed are regulated according to at least one of the following process steps:

the residues are returned only as long as, and only in such an amount that, the changes thus caused in the essential combustion parameters remain within previously defined tolerance limits;

the combustion conditions of the combustion process are changed in such a way as to counteract the changes in the combustion parameters produced by the return;

the material composition of the combustion residue is changed by the return of selected fractions of the combustion residue in such a way that the melting and/or sintering process of the combustion residue is influenced; and the material composition of the combustion residue is changed by the addition of additives in such a way that the melting and/or sintering process of the combustion residue is influenced.

Only a single one of the indicated process steps is sufficient to solve the problem described above. The larger the number of these process steps which are used jointly, the more favorable the combustion conditions and the larger the quantity of combustion residue which can be returned.

In one embodiment of the invention, the selected fractions of the combustion residue have a grain size of approximately 2-10 mm.

In conjunction with the change in material composition, it is also possible to change the composition of the combustion bed on the grate in such a way that the melting and/or sintering processes are accelerated or proceed at lower temperatures. For this purpose, substances which have the effect of lowering the melting point can be mixed into the fuel or into the combustion residues to be returned. These can be silicate compounds such as boron silicate and similar compounds. In principle, therefore, any substance known to produce such effects can be used.

In an advantageous embodiment of the invention, scrap metal and especially scrap iron is used as an additive. This scrap can be recovered from the grate by known separation methods, or it can be obtained from an external source.

It is advantageous to grind up the scrap metal before it is added. The ground-up scrap metal can have a grain size of approximately 1-20 mm.

The combustion or partial combustion of this scrap metal leads to the formation of metal oxides and to the local release of large amounts of heat, which has an advantageous effect on the melting and sintering behavior. This is especially true when the basicity of the combustion residue is decreased as a result. The basicity can be defined in simplified form as:

$$B=(x_{CaO}+x_{FeO})/(x_{SiO2}+x_{Fe2O3}),$$

where x stands for the molar fraction of the oxide component relative to an average composition of combustion residue. A preferred type of return is to meter the addition of scrap metal in such a way that the basicity B of the combustion residue is between approximately 0.3 and 0.7. A preferred method of regulating the basicity of the combustion residue is to adjust the degree to which the scrap metal supplied or recycled as an additive is ground up. For example, the scrap metal can be ground up more finely when the basicity of the combustion residue is above a predetermined limit in the range of approximately 0.3-0.7.

In another advantageous embodiment of the invention, the combustion residue can be returned directly to the combustion chamber. It is advantageous in this case for the combustion residue to be returned to the grate.

A preferred form of return is to return the combustion residue to the feeding disk. When this method is used, it is possible to determine very quickly how the combustion process is being affected, and at the same time this return method is advantageous because the temperatures on the feeding disk are not yet as high as they are in the primary combustion zone, as a result of which the device used to return the residue is not subjected to extreme temperature loads.

The combustion process can be influenced in an advantageous manner by monitoring one of the essential combustion parameters, namely, the position of the burn-out zone. The feed of combustion residue should be reduced, for example, when the burn-out zone starts to migrate toward the discharge end of the grate as a result of a drop in the calorific value of the fuel/residue mixture present on the grate. Conversely, the amount of combustion residue being returned should be increased when the burn-out zone starts to migrate toward the feed end.

The expert can choose from among many different methods for changing and monitoring the essential combustion parameters.

One of the essential combustion conditions is the weight of fuel supplied per unit time. In addition to the weight of the fuel, essential combustion parameters include the calorific value of the fuel, its moisture content, and its ash content.

If the calorific value of the fuel drops, the amount of combustion residue supplied should be decreased and vice versa.

The moisture content of the fuel can be determined even before it reaches the combustion chamber by the use of a microwave detector, for example, installed in the area of the fuel loading or feed shaft. When the moisture content increases, the calorific value of the fuel decreases, even though its composition may otherwise remain the same, so that the amount of combustion residue supplied should be decreased—and vice versa.

Other essential combustion parameters are the temperature of the combustion bed and the temperature distribution over the combustion bed. These combustion parameters can be monitored by means of an infrared camera, for example. Higher temperatures of the combustion bed make it possible to return larger amounts of combustion residue and vice versa.

Another essential combustion condition is the amount of combustion air, including the amounts of both the primary and the secondary combustion air as well as possibly the amount of returned off-gas.

Another essential combustion condition is the temperature of the combustion air, which is adjusted, for example, by means of an air preheater.

The combustion process can be strongly influenced by another essential combustion condition, namely, the oxygen content of the combustion air, because the control of the oxygen content exerts a significant effect on the primary combustion process and especially on the temperature of the combustion bed.

Another essential combustion condition is the point at which the combustion air is introduced. Especially sensitive control can be achieved here by dividing the grate both in the longitudinal direction and in the transverse direction into several under-grate blast zones, each of which is supplied with primary air and oxygen at specially calculated rates.

Other essential combustion conditions with which the combustion process can be influenced significantly are the stoking speed of the grate (that is, the speed at which the fuel is turned over within the combustion bed) and the duration of the stoking. These two factors determine the rate at which the fuel is turned over within the combustion bed. Especially suitable for this purpose is a reciprocating grate slanted down toward the discharge end, where every other grate section is movable and the sections in between are stationary. With this design, the fuel is turned over continuously as it travels from the feed end to the discharge end, so that fuel components which were on the top of the fuel bed for a certain period of time wind up at the bottom, directly on the grate. Fuel which is already incandescent is thus mixed effectively with the freshly added fuel in the starting area, and the fuel in the areas farther down, toward the discharge end, is effectively aerated and loosened.

To establish arbitrary limits within which combustion residues are returned, it is possible to use the amount of heat released and the emission of pollutants, both of which will have an effect on the setting of these limits.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The invention is explained in greater detail below on the basis of a flow chart and an exemplary embodiment of an incinerator.

DETAILED DESCRIPTION OF THE PRESENTLY PREFERRED EMBODIMENTS

Figure 1:
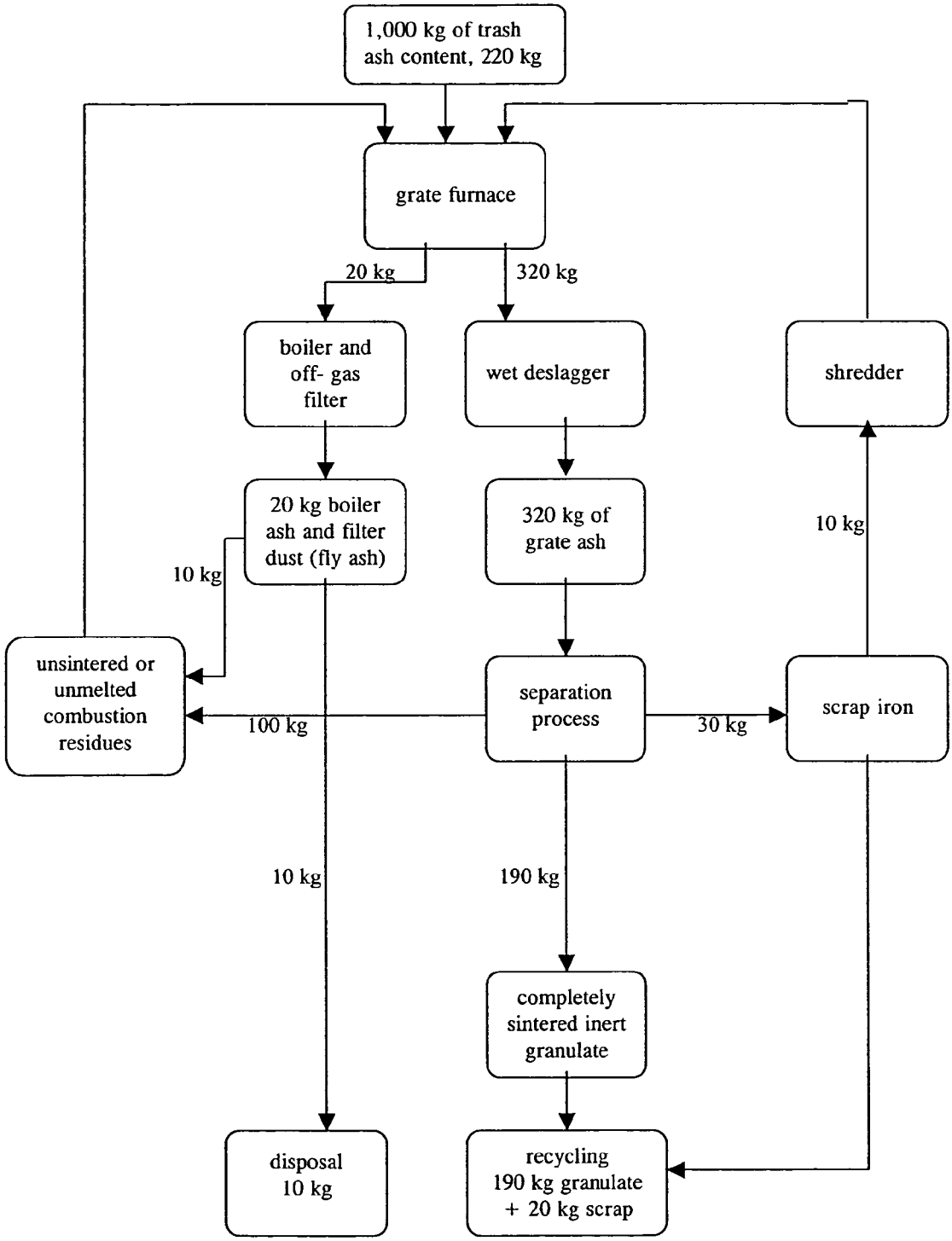
FIG. 1 shows a flow chart of a basic process.

As shown in FIG. 1, 1,000 kg of trash with an ash content of 220 kg is dumped onto a furnace grate and burned in such a way that 25-75% of the combustion residue obtained is already converted completely to sintered slag. The total weight of the combustion residue, including that which was previously returned, is 340 kg. Of this amount, 320 kg falls into a wet deslagger, is quenched there, and then discharged. 190 kg of completely sintered inert granulate and 30 kg of scrap iron are separated from this residue by a separation process, which comprises a sieving and possibly a washing step as well as a magnetic metal separation step. The granulate and some of the scrap iron are sent on to other recycling processes. The amount of scrap iron which is returned depends on the basicity of the combustion residue. In this example, 10 kg of scrap iron is returned, and 20 kg is sent for recycling. 110 kg of combustion residue which has not yet been sintered is sent back to the combustion process. The remaining of the 340 kg combustion residue is 20 kg of fly ash leaving the combustion chamber with the off-gases. 50% of this ash is returned in the present example, and the other 50% is sent to a separate disposal process.

Figure 2:
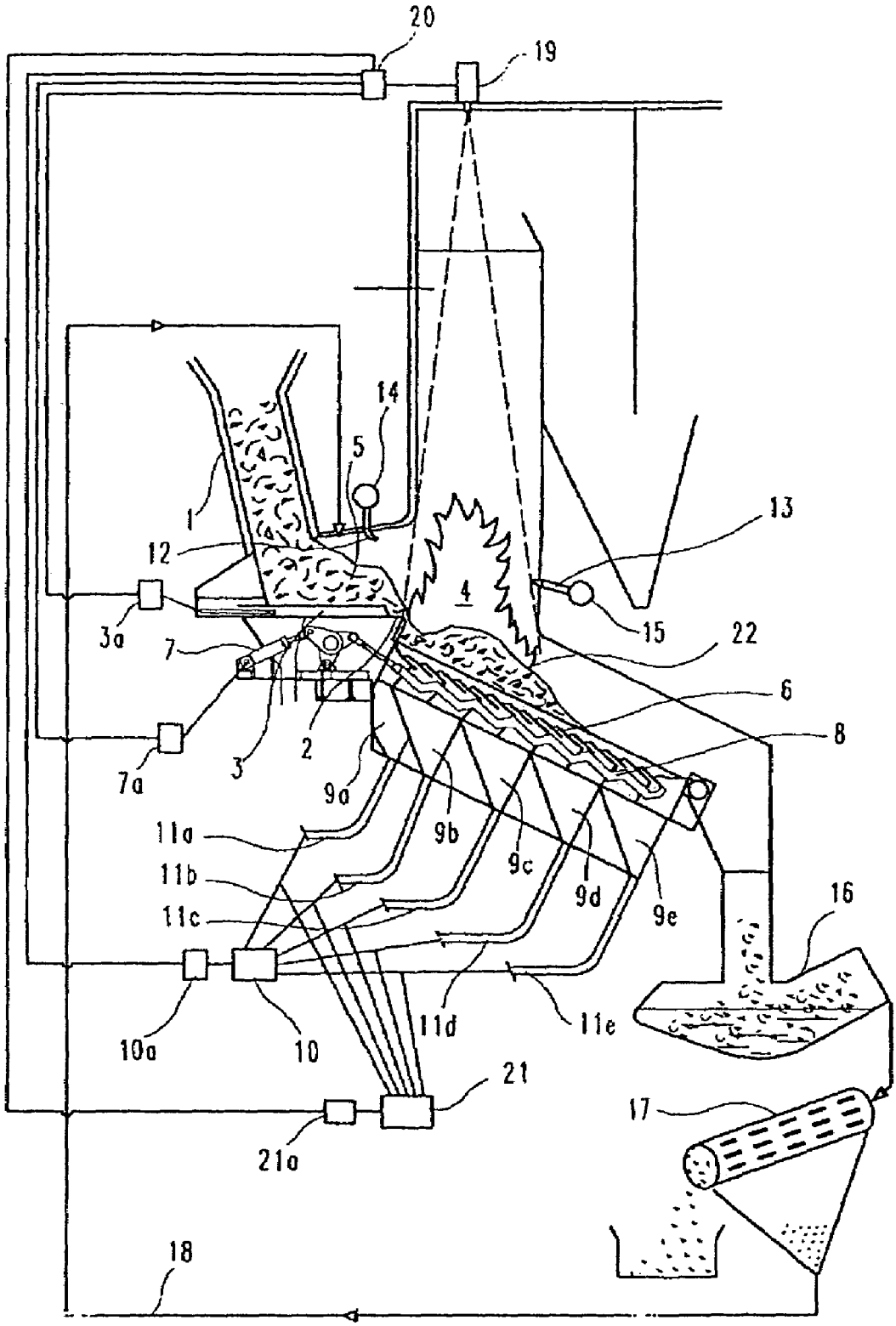
FIG. 2 shows a schematic diagram of an incinerator for implementing the process.

The incinerator illustrated schematically in FIG. 2 comprises a feed shaft 1, into which the fuel is loaded, and a feeding disk 2 with a charging element 3, which conveys the fuel into the combustion chamber 4. 3*a* designates a variable drive device, which makes it possible to regulate the rate at which the fuel is loaded as a function of a combustion parameter. Here the fuel, designated 5, drops onto a grate 6, which is designed as a reciprocating grate, and which executes stoking movements under the action of a drive unit 7. For this purpose, the drive unit 7 acts on the transmission element 8 to which every second grate section is connected, which means that a stationary grate section follows every movable grate section. An automatic controller 7*a* provides a variable drive so that the stoking speed can be adjusted as a function of other combustion parameters. In the case of the grate shown here, five different under-grate blast chambers 9*a*-9*e* are provided in a row in the longitudinal direction, each of which is also divided in the transverse direction, so that the quantity and distribution of the primary combustion air can be adapted to the specific requirements on the grate. The primary combustion air is supplied by a blower 10, indicated schematically, and the flow rate of the combustion air is regulated by valves (not shown) in the individual feed lines 11*a*-11*e*. The combustion air feed rate is controlled by means of an automatic controller 10*a*. The numbers 12 and 13 designate secondary air nozzles, which lead from feed lines 14 and 15, through which secondary air can be introduced into the combustion chamber 4.

At the bottom end of the grate, the slag and other combustion residues fall into a wet deslagger 16, from which they are sent to a separator 17. The unsintered or unmelted residual slag is then sent through a line 18 to the loading area above the feeding disk and mixed with the fuel, thus arriving back on the grate again. The separator, designated 17, is intended merely to symbolize in schematic fashion the separation process explained in conjunction with FIG. 1. An infrared camera 19 monitors the combustion process on the grate 6. A central control unit 20 controls the various controllers, i.e., controller 3*a* which adjusts the feed rate, controller 7*a* for the stoking speed, controller 10*a* for the primary air feed rate, and controller 21*a* for the oxygen feed rate, which is supplied through a distributor 21 to the individual primary air chambers 9*a*-9*e*.

The system works in the following way:

As already described in conjunction with FIG. 1, the goal of this process is to return unmelted or unsintered combustion residue to the combustion process. Thus, for example, an infrared camera 19 monitors the combustion bed and thus determines the distribution of the combustion mass and the temperature of the combustion bed. As a function of these combustion parameters, a central control unit 20 will tell the controller 3*a*, for example, how to adjust the amount of fuel being supplied. This central control unit can also tell the controller 10*a* how to change the feed rate of combustion air. Another possibility is for the central control unit 20 to tell the controller 7*a* how to change the stoking speed. A controller 21*a*, which is also commanded by the central control unit 20, adjusts the amount of oxygen being supplied to the individual under-grate blast chambers 9*a*-9*e*. In the exemplary embodiment shown here, of course, not all of the possible control options are shown schematically; on the contrary, only a few of the especially important control operations are shown, by means of which it is possible to control the combustion process in such a way that as much of the combustion residue as possible can be returned to the grate.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A process for influencing properties of combustion residue from a combustion process, in which fuel is burned on a grate of a combustion bed in a combustion chamber and accumulated unmelted or unsintered combustion residue derived from slag produced on the combustion bed is returned to the combustion process, the influencing process comprising:

regulating a melting process or sintering process in the combustion bed by returning the combustion residue to the combustion process only as long as, and only in such an amount that, a change in at least one essential combustion parameter caused by the return of the combustion residue remains within a predetermined tolerance limit;

wherein said step of regulating comprises monitoring the at least one essential combustion parameter and increasing or reducing the feed of combustion residue to the combustion process in response to said step of monitoring.

2. The process of claim 1, wherein the combustion residue is returned directly to the combustion chamber.

3. The process of claim 2, wherein the combustion residue is returned to the grate.

4. The process of claim 2, wherein the combustion residue is returned to a feeding disk of the combustion bed.

5. The process of claim 1, wherein the at least one essential combustion parameter comprises a location of a burn-out zone in the combustion bed.

6. The process of claim 1, further comprising the step of setting at least one essential combustion condition, wherein the at least one essential combustion condition comprises a weight of fuel supplied per unit time.

7. The process of claim 1, wherein the at least one essential combustion parameter comprises a calorific value of the fuel.

8. The process of claim 1, wherein the at least one essential combustion parameter comprises a moisture content of the fuel.

9. The process of claim 1, wherein the at least one essential combustion parameter comprises a temperature of the combustion bed or a temperature distribution over the combustion bed.

10. The process of claim 1, further comprising the step of setting at least one essential combustion condition, wherein the at least one essential combustion condition comprises a feed rate of a combustion air.

11. The process of claim 1, further comprising the step of setting at least one essential combustion condition, wherein the at least one essential combustion condition comprises a temperature of a combustion air.

12. The process of claim 1, further comprising the step of setting at least one essential combustion condition, wherein the at least one essential combustion condition comprises an oxygen content of a combustion air.

13. The process of claim 1, further comprising the step of setting at least one essential combustion condition, wherein the at least one essential combustion condition comprises an introduction point of a combustion air.

14. The process of claim 1, further comprising the step of setting at least one essential combustion condition, wherein the at least one essential combustion condition comprises a stoking speed of the grate.

15. The process of claim 1, wherein the predetermined tolerance limit is influenced by release of heat.

16. The process of claim 1, wherein the predetermined tolerance limit is influenced by emission of pollutants.

* * * * *